US010167687B2

(12) United States Patent
Huber et al.

(10) Patent No.: US 10,167,687 B2
(45) Date of Patent: Jan. 1, 2019

(54) MAGAZINE FOR DRILLING RODS

(71) Applicant: BAUER Deep Drilling GmbH, Schrobenhausen (DE)

(72) Inventors: Thomas Huber, Aichach (DE); Martin Baur, Ehekirchen (DE); Stefan Hackl, Aichach (DE); Manuel Ostermeier, Pobenhausen (DE)

(73) Assignee: BAUER Deep Drilling GmbH, Schrobenhausen (DE)

( * ) Notice: Subject to any disclaimer, the term of this patent is extended or adjusted under 35 U.S.C. 154(b) by 94 days.

(21) Appl. No.: 15/361,753

(22) Filed: Nov. 28, 2016

(65) Prior Publication Data

US 2018/0148987 A1 May 31, 2018

(51) Int. Cl.
*E21B 19/14* (2006.01)

(52) U.S. Cl.
CPC ..... *E21B 19/14* (2013.01)

(58) Field of Classification Search
CPC ..... E21B 19/14; E21B 19/1915; E21B 19/20; E21B 19/146
USPC ..... 414/22.71, 22.63
See application file for complete search history.

(56) References Cited

U.S. PATENT DOCUMENTS

| | | | | |
|---|---|---|---|---|
| 1,718,395 | A | 6/1929 | Webb et al. | |
| 2,507,040 | A | 5/1950 | Moore | |
| 3,616,941 | A * | 11/1971 | Walling | B65G 1/0442 211/70.4 |
| 2006/0104747 | A1* | 5/2006 | Zahn | E21B 19/14 414/22.63 |
| 2011/0005162 | A1 | 1/2011 | Roodenburg et al. | |
| 2013/0032405 | A1* | 2/2013 | Braxton | E21B 19/14 175/57 |
| 2015/0048038 | A1 | 2/2015 | Roodenburg et al. | |

FOREIGN PATENT DOCUMENTS

| | | |
|---|---|---|
| DE | 1 812 304 A1 | 7/1969 |
| EP | 2 947 258 B1 | 9/2016 |

* cited by examiner

*Primary Examiner* — Cathleen R Hutchins
(74) *Attorney, Agent, or Firm* — Studebaker & Brackett PC

(57) ABSTRACT

The invention relates to a drill rod magazine for vertical storage of drill rod elements, having a base frame, on which at least one support means is arranged that has two substantially horizontally directed retaining arms which, by formation of a receiving area, are parallel to and spaced apart from each other, wherein the drill rod elements are retained in a vertical position between the retaining arms. Along at least one retaining arm a clamping rod is supported in a movable manner which is in operative connection with a tensioning means that exerts a tensioning force onto the drill rod elements for retaining the drill rod elements in a clamping manner in the receiving area.

9 Claims, 5 Drawing Sheets

MAGAZINE FOR DRILLING RODS

FIELD OF THE INVENTION

The invention relates to a drill rod magazine for vertical storage of drill rod elements, having a base frame, on which at least one support means is arranged that has two substantially horizontally directed retaining arms which, by formation of a receiving area, are parallel to and spaced apart from each other, wherein the receiving area is designed for receiving several drill rod elements in a row next to each other and the drill rod elements are retained in a vertical position between the two retaining arms.

BACKGROUND OF THE INVENTION

A generic drill rod magazine can be taken from EP 2 947 258 B1 for example. On a foldable frame of metal struts several support means with retaining arms are provided which extend horizontally in a fork-like manner. Between the retaining arms drill rod elements can be received and stored vertically. With this drill rod magazine a plurality of drill rod elements can be stored in a compact manner in vertical alignment.

Another drill rod magazine is known from U.S. Pat. No. 1,718,395. On a fork-shaped support means with horizontal retaining arms a plurality of lateral arched tensioning elements is arranged which retain the bar-shaped drill rod elements in their position in their upper area.

Further drill rod magazines with fork-shaped support means which are additionally provided with retaining means can be taken from U.S. Pat. No. 2,507,040, US 2011/0005162 A1 and US 2015/0048038 A1.

Another drill rod magazine can be taken from DE 1 812 304, in which pivotable fixing elements are arranged on the retaining arms of a support means. Between the fixing elements the drill rod elements are arranged and fixed in their vertical storage position.

Although the arrangement of a plurality of fixing elements permits secure storage, retaining arms with a plurality of individually adjustable elements are elaborate in terms of construction, production and maintenance. Especially in rough operation there is the risk of damage or malfunction of the plurality of movable parts.

SUMMARY OF THE INVENTION

The invention is based on the object to provide a drill rod magazine, which, whilst having a simple and robust construction, allows secure storage of drill rod elements.

In accordance with the invention the object is achieved by a drill rod magazine for vertical storage of drill rod elements, having a base frame, on which at least one support means is arranged that has two substantially horizontally directed retaining arms which, by formation of a receiving area, are parallel to and spaced apart from each other, wherein the receiving area is designed for receiving several drill rod elements in a row next to each other and the drill rod elements are retained in a vertical position between the retaining arms, wherein along at least one retaining arm a clamping rod is supported in a movable manner which is in operative connection with a tensioning means that exerts a tensioning force onto the drill rod elements for retaining the drill rod elements in a clamping manner in the receiving area.

According to a basic idea of the invention a clamping rod is arranged along at least one retaining arm, the said clamping rod being preferably supported in a movable manner between a clamping position and a retracted position. In the clamping position the clamping rod rests with a clamping force against the external circumference of the drill rod elements so that these are pressed against the opposite retaining arm. As a result, a reliable force-locked fixing of the drill rod elements through a predetermined tensioning force of the clamping rod is attained.

According to a preferred further development of the invention provision is made in that in the two opposite retaining arms of a support means a clamping rod with a tensioning means is arranged in each case. Thus, in both retaining arms of a support means a clamping rod is provided in each case. These exert a clamping force against each other, whereby drill rod elements are particularly reliably fixed in a force-locked manner in the receiving space in the support means.

Basically, the clamping rods can be produced of any suitable material. According to an embodiment variant of the invention it is especially preferred that the clamping rods are formed of a metal profile and, for the purpose of contacting the drill rod elements, have a contact side that is provided with an elastic element. Thus, the clamping rod has a metal base body consisting in particular of a profile, e.g. of steel or aluminum. On a front contact side directed to the drill rod element an elastic element is arranged. Through this, the clamping and frictional force between the clamping rod and the drill rod element is increased. Due to an elastic deformability of the element on the contact side a certain form-locked fixing of the drill rod element is also brought about. Moreover, since the elastic element adapts itself in an arched manner, the contact surface between the clamping rod and the drill rod element is augmented. This also increases the adhesive and frictional forces, which leads to an improved positional fixing.

The elastic element can be formed of a suitable material, such as a plastic material. According to the invention it is particularly preferred that the elastic element is a rubber strip. This is both inexpensive and robust.

A further improvement of the retaining effect can be achieved in the case of the drill rod magazine according to the invention in that the clamping rod has a contact side that contacts the drill rod element and is provided with a wave contour. The wave contour has wave troughs which are preferably formed to match an external circumference of the drill rod elements. The wave-shaped contact side can be formed of a metal material or an elastic material, hence also a rubber strip. The wave contour increases the adhesive and frictional forces.

The invention is developed further in that several support means are provided, several retaining arms are arranged in a fork-like manner next to each other, by means of at least two pivot levers the clamping rod is supported in a pivotable manner with respect to the retaining arms and the pivot levers are acted upon by tension springs which press the clamping rods into a clamping position. To apply the tensioning force different elements can be provided, such as hydraulic or pneumatic tensioning cylinders or rubbery-elastic elements. By particular preference, tension springs, more particularly extension springs, are provided which preferably act upon pivot levers, on which the clamping rod is supported. The pivot levers are preferably supported in a pivotable manner in a horizontal plane and enable a good pressing of the clamping rod against vertically arranged drill rod elements.

For horizontal insertion of the drill rod elements into the drill rod magazine it is advantageous in accordance with an embodiment variant of the invention that the at least one clamping rod has a lead-in slope at its front side. The lead-in slope tapers towards the internal side.

Basically, the tensioning means according to the invention is sufficient to retain drill rod elements reliably in their storage position in the drill rod magazine. To further enhance the positional security a preferred embodiment variant of the invention resides in the fact that on the retaining arms bar-shaped fixing elements are movably supported by being pivotable between a vertical release position and a horizontal fixing position. The fixing elements are arranged at a distance corresponding to the diameter of the drill rod elements so that in the fixing position the fixing elements engage laterally between the drill rod elements arranged next to each other. The fixing elements can be actuated individually by separate pivot drives, such as hydraulic or pneumatic positioning cylinders. Advantageously, a central drive mechanism with a single drive can be provided, in which case the drive mechanism actuates the fixing elements simultaneously. The actuating mechanism can in particular be a lever mechanism which is in operative connection with a central positioning cylinder.

Basically, only one single fixing element can be provided on a retaining arm, in particular at the open end of the receiving space. According to a further development of the invention a particularly good positional fixing is achieved in that in the fixing position a drill rod element is received and fixed between two adjacent fixing elements. Thus, the number of fixing elements preferably corresponds to the maximum number of drill rod elements to be received in the receiving space of a support means.

Furthermore, it is advantageous for the fixing elements to be jointly or individually pivotable.

BRIEF SUMMARY OF THE DRAWINGS

In the following the invention is described further by way of preferred embodiments illustrated schematically in the drawings, wherein show:

In FIG. 1 a drill rod magazine 10 according to the invention is illustrated in an operating state. The drill rod magazine 10 has a box-like base frame 12 which has a plate-shaped bearing area 13. Similar to a framework, a first side wall 14, an opposite second side wall 15 and an intermediate wall 16 arranged in-between are mounted on a base plate of the bearing area 13. The first side wall 14, the second side wall 15 and the intermediate wall 16 extend vertically and parallel to each other up to an equal height. Between the vertically directed walls receiving shelves 20 that are arranged substantially horizontally are provided substantially at three height levels. The receiving shelves 20 each have a cross beam 22, on which a plurality of transversely directed retaining arms 24 are mounted which extend in a rake-like manner in the horizontal direction towards a front-side open access area 18 of the drill rod magazine 10.

Figure 1:
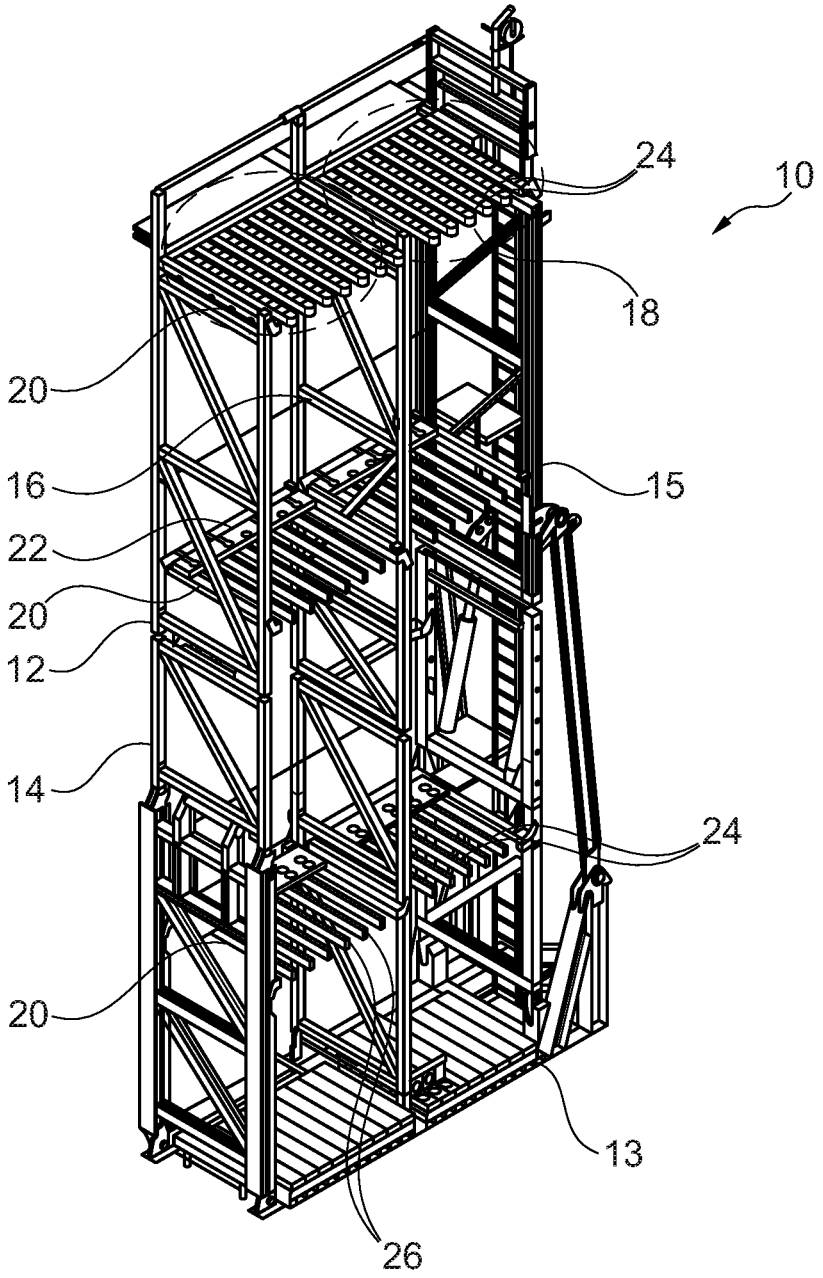
FIG. 1 a perspective view of a drill rod magazine according to the invention.

Between the individual retaining arms 24 slot-shaped free spaces are arranged which are designed as receiving areas 26 for inserting vertically directed drill rod elements. The drill rod elements rest on the bearing area 13 and extend up to one of the receiving shelves 20.

The drill rod magazine 10 is foldable by means of a folding mechanism, not explained in greater detail, as known from EP 2 947 258 B1.

Figure 2:
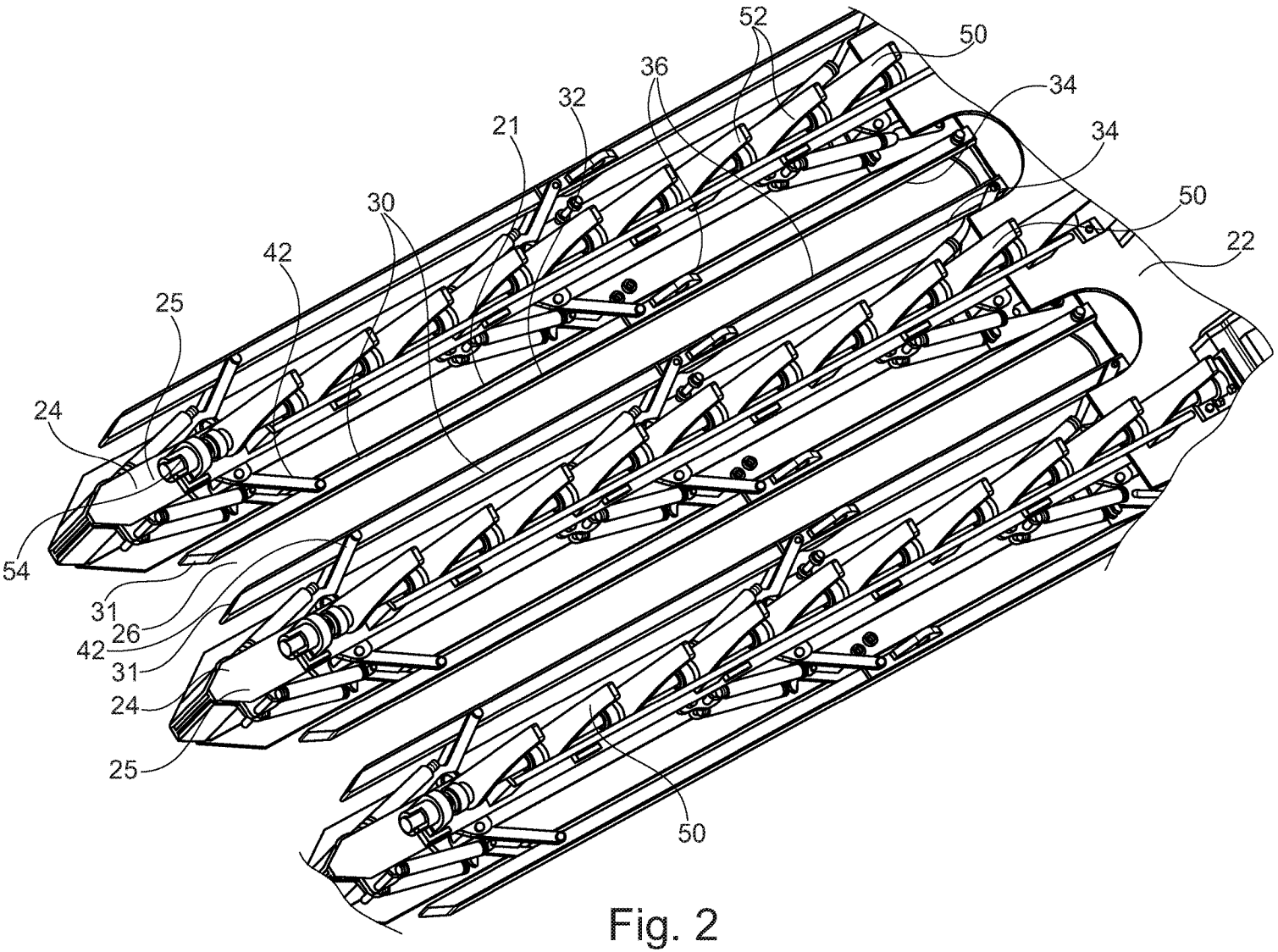
FIG. 2 an enlarged detailed view of support means on the drill rod magazine of FIG. 1.

In this embodiment the upper horizontal receiving shelf 20 is provided with several retaining arms 24 with support means 21 along the horizontal retaining arms 24. The support means 21 can also be provided on one or several other receiving shelves 20. The support means 21 are illustrated in greater detail in FIG. 2.

The horizontally directed retaining arms 24 each have a center beam 25 which is connected in an approximately rectangular manner to the cross beam 22 of the receiving shelf 20. Between two opposite, parallel extending retaining arms 24 a receiving area 26 is designed for receiving drill rod elements, not depicted, in vertical alignment.

Via pivot levers 42 clamping rods 30 are supported in a horizontally movable manner along each longitudinal side of a retaining arm 24. In the access area 18 the clamping rods 30 each have a lead-in slope 31 to facilitate horizontal insertion of a drill rod element from the front into the receiving area 26 between two clamping rods 30. On the contact side 32 of each clamping rod 30 which is directed towards the drill rod element to be received a rubber strip is arranged as an elastic element 34 with a wave contour 36.

Moreover, on an upper side of the retaining arms 24 a fixing means 50 with a plurality of parallel arranged bar-shaped fixing elements 52 is provided in each case. The fixing elements 52 are each designed horizontally with a distance to each other which is slightly larger than a diameter of the drill rod element to be received. The fixing elements 52 which are illustrated in an upward-pivoted idle position in FIG. 2 can be pivoted clockwise by means of the pivot axis 54 from the vertical position into an approximately horizontal operating or fixing position into the receiving area 26 between drill rod elements. In this operating position the fixing elements 52 constitute a form-locked positional securing of received drill rod elements.

Figure 3:
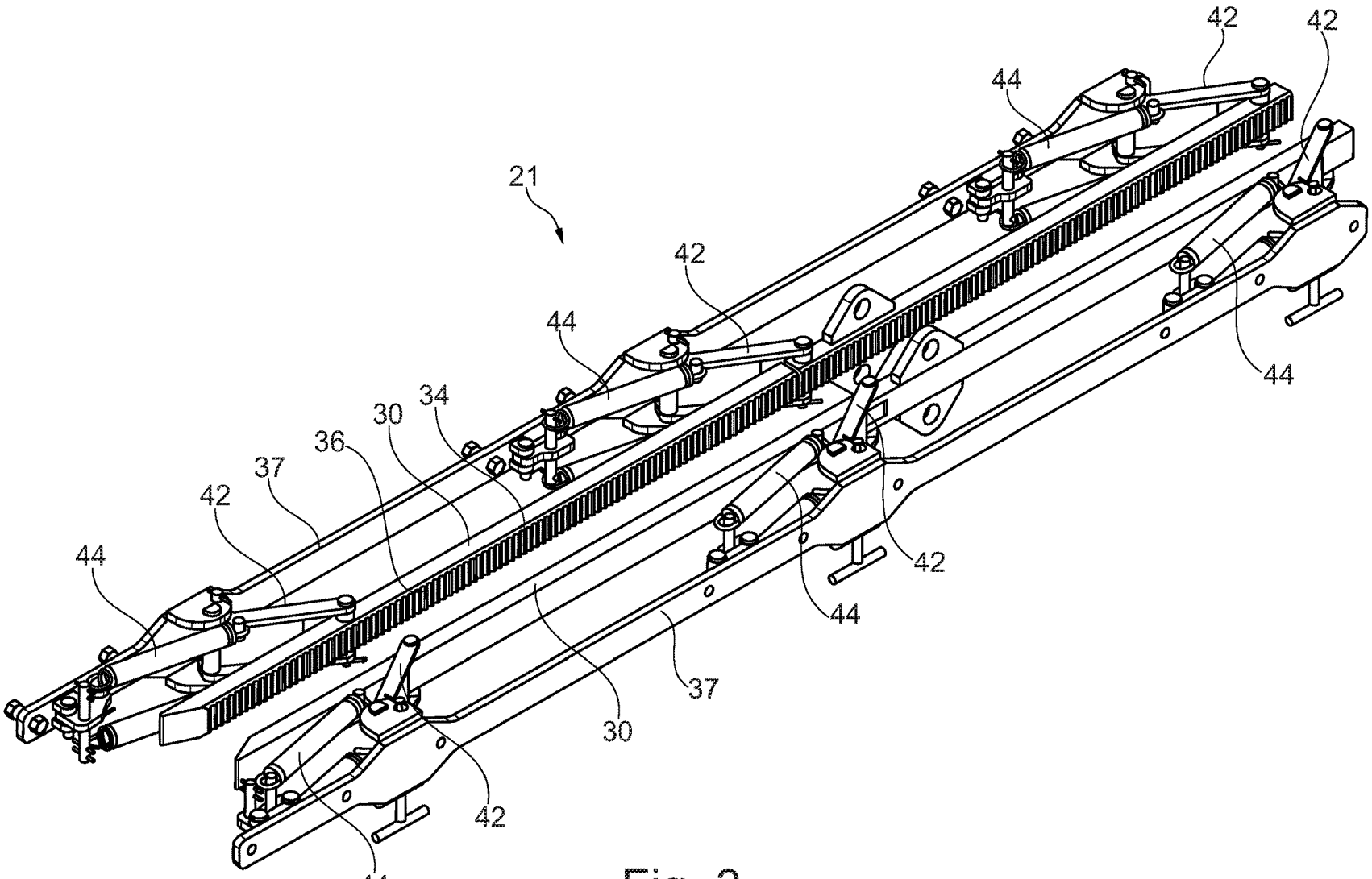
FIG. 3 a perspective view concerning the functioning of a support means.
Figure 4:
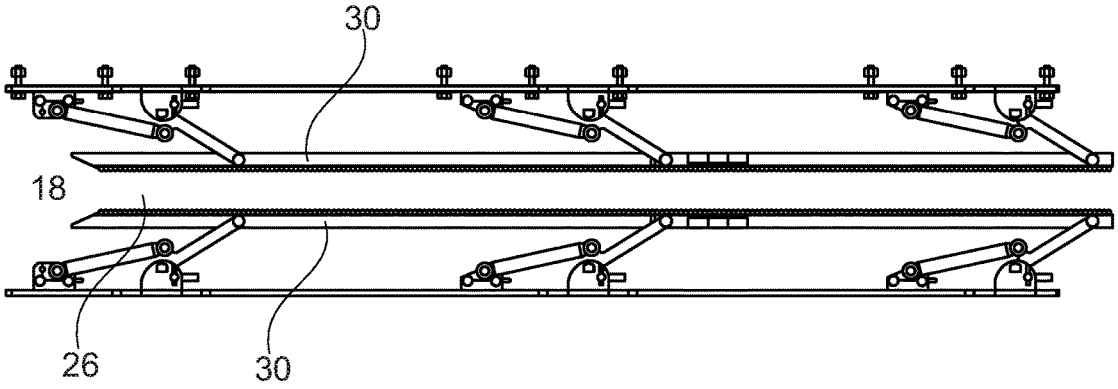
FIG. 4 a plan view of the mechanism of a support means in an idle state.

The functioning of a support means 21 for applying clamping forces onto received drill rod elements will be explained in greater detail hereinafter in conjunction with FIGS. 3 to 5.

The support means 21 has two opposite base plates 37 which are each fastened on lateral areas of the center beams of the retaining arms. On the elongate base plates 37 a clamping rod 30 is in each case pivotably linked via three double pivot levers 42 arranged offset to each other. By way of a pivot joint with a vertical pivot axis the pivot levers are attached on the one hand to the clamping rod 30 and on the other hand to the base plate 37. In a lower area of each pivot lever 42 directed to the base plate 37 a tension spring 44 engages which is fastened at its opposite end on the base plate 37. The tension spring 44 is designed as an extension spring, through which the clamping rods 30 are each tensioned relative to each other in an idle position, which is illustrated in FIG. 4.

Figure 5:
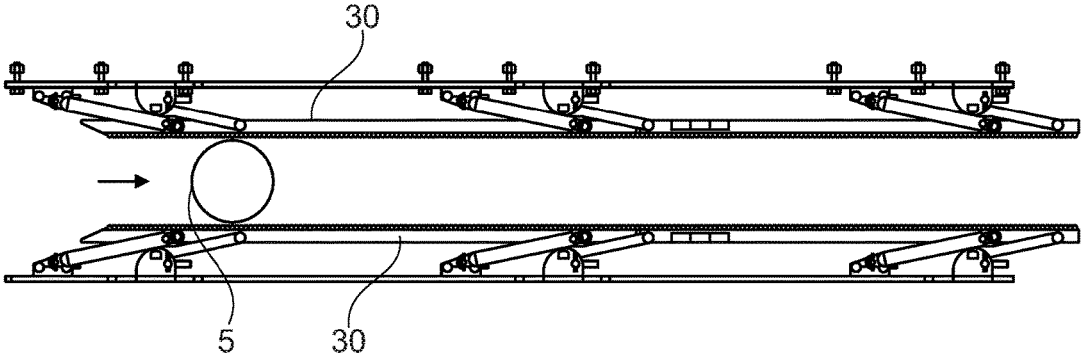
FIG. 5 a plan view of the support means of FIG. 4 when receiving a drill rod element.

From an access area 18 a vertically arranged drill rod element 5 can be inserted e.g. by a crane means into the receiving area 26 between the clamping rods 30 directed towards each other, as illustrated in FIG. 5. By inserting the drill rod element 5 the clamping rods 30 are pressed apart contrary to the effect of the tension springs 44 of the tensioning means. As a result, a tensioning or clamping force is exerted by the opposite clamping rods 30 onto a drill rod element 5 in the receiving area 26. In this way, the position of a drill rod element 5 in the support means 21 is secured.

The invention claimed is:

1. A drill rod magazine for vertical storage of drill rod elements, comprising:

a base frame, on which at least one support means is arranged, wherein the at least one support means has two substantially horizontally directed retaining arms which, by formation of a receiving area, are parallel to and spaced apart from each other, wherein the receiving area is designed for receiving the drill rod elements in a row next to each other and the drill rod elements are retained in a vertical position between the two retaining arms, wherein along at least one retaining arm a clamping rod is supported in a movable manner which is in operative connection with a tensioning means that exerts a tensioning force onto the drill rod elements for retaining the drill rod elements in a clamping manner in the receiving area, wherein several support means are provided, several retaining arms are arranged in a fork-like manner next to each other, by means of at least two pivot levers the clamping rod is supported in a pivotable manner with respect to the retaining arms, and the pivot levers are acted upon by tension springs which press the clamping rods into a clamping position.

2. The drill rod magazine according to claim 1, wherein in the two opposite retaining arms of the support means the clamping rod with the tensioning means is arranged in each case.

3. The drill rod magazine according to claim 1, wherein the clamping rods are formed of a metal profile and, for the purpose of contacting at least one of the drill rod elements, the clamping rods have a contact side that is provided with an elastic element.

4. The drill rod magazine according to claim 3, wherein the elastic element is a rubber strip.

5. The drill rod magazine according to claim 1, wherein the clamping rod has a contact side that contacts at least one of the drill rod elements and is provided with a wave contour.

6. The drill rod magazine according to claim 1, wherein the at least one of the clamping rods has a lead-in slope at a front side of the at least one of the clamping rods.

7. The drill rod magazine according to claim 1, wherein on the retaining arms bar-shaped fixing elements are movably supported by being pivotable between a vertical release position and a horizontal fixing position.

8. The drill rod magazine according to claim 7, wherein in the fixing position at least one of the drill rod elements is received and fixed between two adjacent fixing elements.

9. The drill rod magazine according to claim 7, wherein the fixing elements are jointly or individually pivotable.

* * * * *